US012759111B2

(12) United States Patent
Eckel et al.

(10) Patent No.: US 12,759,111 B2
(45) Date of Patent: Oct. 13, 2026

(54) COATED ABRASIVE BELT AND METHODS OF MAKING AND USING THE SAME

(71) Applicant: 3M INNOVATIVE PROPERTIES COMPANY, St. Paul, MN (US)

(72) Inventors: Joseph B. Eckel, Vadnais Heights, MN (US); Aaron K. Nienaber, Maplewood, MN (US); Erin D. Spring, Darien Center, NY (US); Brant A. Moegenburg, Baldwin, WI (US); Eric M. Moore, Roseville, MN (US); Thomas J. Nelson, Woodbury, MN (US); Thomas P. Hanschen, Mendota Heights, MN (US); Steven J. Keipert, Houlton, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 979 days.

(21) Appl. No.: 17/292,213

(22) PCT Filed: Nov. 14, 2019

(86) PCT No.: PCT/IB2019/059796
§ 371 (c)(1),
(2) Date: May 7, 2021

(87) PCT Pub. No.: WO2020/100084
PCT Pub. Date: May 22, 2020

(65) Prior Publication Data

US 2022/0001516 A1 Jan. 6, 2022

Related U.S. Application Data

(60) Provisional application No. 62/767,888, filed on Nov. 15, 2018.

(51) Int. Cl.
*B24D 11/00* (2006.01)

(52) U.S. Cl.
CPC ..... *B24D 11/00* (2013.01); *B24D 11/001* (2013.01); *B24D 2203/00* (2013.01)

(58) Field of Classification Search
CPC ..... B24D 18/00; B24D 18/0009; B24D 18/0072; B24D 2203/00; B24D 11/00; B24D 11/001; B24D 11/005
(Continued)

(56) References Cited

U.S. PATENT DOCUMENTS 1,910,444 A 5/1933 Nicholson
3,041,156 A 6/1962 Rowse
(Continued)

FOREIGN PATENT DOCUMENTS

CN 85202722 U 4/1986
CN 201519910 U 7/2010
(Continued)

OTHER PUBLICATIONS

International Search Report for PCT International Application No. PCT/IB2019/059796, mailed on Feb. 20, 2020, 4 pages.

*Primary Examiner* — Brian D Keller
*Assistant Examiner* — Alberto Saenz
(74) *Attorney, Agent, or Firm* — Kathleen B. Gross; Ford B. Wright

(57) ABSTRACT

A coated abrasive belt (100) includes a belt backing (110) and an abrasive layer disposed thereon. The abrasive layer comprises abrasive elements (160) secured to at least a portion of a major surface of the belt backing (110) by at least one binder material. The abrasive elements are disposed at contiguous intersections of horizontal (192) and vertical lines (194) of a rectangular grid pattern. Each abrasive element has at least two triangular abrasive plate-
(Continued)

lets (130), each having respective top and bottom surfaces connected to each other, and separated by, three sidewalls. On a respective basis, one sidewall of the triangular abrasive platelets is disposed facing and proximate to the belt backing. A first portion of the abrasive elements is arranged in alternating first rows (16) wherein the triangular abrasive platelets are disposed lengthwise aligned with the vertical lines (194). A second portion of the abrasive elements is arranged in alternating second rows (168) wherein the triangular abrasive platelets (130) are disposed lengthwise aligned with the horizontal lines (194). The first and second rows repeatedly alternate along the vertical lines. Methods of making and using the coated abrasive belt are also disclosed.

20 Claims, 5 Drawing Sheets

(58) Field of Classification Search
USPC ..... 451/59, 63, 526, 548
See application file for complete search history.

(56) References Cited

U.S. PATENT DOCUMENTS

| | | | |
|---|---|---|---|
| 3,716,950 | A | 2/1973 | McClure |
| 4,062,153 | A | 12/1977 | Malm |
| 4,314,827 | A | 2/1982 | Leitheiser |
| 4,615,151 | A | 10/1986 | Huber |
| 4,623,364 | A | 11/1986 | Cottringer |
| 4,652,275 | A | 3/1987 | Bloecher |
| 4,734,104 | A | 3/1988 | Broberg |
| 4,737,163 | A | 4/1988 | Larkey |
| 4,744,802 | A | 5/1988 | Schwabel |
| 4,751,138 | A | 6/1988 | Tumey |
| 4,770,671 | A | 9/1988 | Monroe |
| 4,799,939 | A | 1/1989 | Bloecher |
| 4,881,951 | A | 11/1989 | Wood |
| 4,997,461 | A | 3/1991 | Markhoff-Matheny |
| 5,009,675 | A | 4/1991 | Kunz |
| 5,011,508 | A | 4/1991 | Wald |
| 5,014,468 | A | 5/1991 | Ravipati |
| 5,042,991 | A | 8/1991 | Kunz |
| 5,085,671 | A | 2/1992 | Martin |
| 5,092,082 | A | 3/1992 | Padberg |
| 5,152,917 | A | 10/1992 | Pieper |
| 5,201,916 | A | 4/1993 | Berg |
| 5,203,884 | A | 4/1993 | Buchanan |
| 5,213,591 | A | 5/1993 | Celikkaya |
| 5,352,254 | A | 10/1994 | Celikkaya |
| 5,366,523 | A | 11/1994 | Rowenhorst |
| 5,378,251 | A | 1/1995 | Culler |
| 5,417,726 | A | 5/1995 | Stout |
| 5,435,816 | A | 7/1995 | Spurgeon |
| 5,436,063 | A | 7/1995 | Follett |
| 5,441,549 | A | 8/1995 | Helmin |
| 5,496,386 | A | 3/1996 | Broberg |
| 5,556,437 | A | 9/1996 | Lee |
| 5,578,096 | A | 11/1996 | Christianson |
| 5,609,706 | A | 3/1997 | Benedict |
| RE35,570 | E | 7/1997 | Rowenhorst |
| 5,672,097 | A | 9/1997 | Hoopman |
| 5,697,359 | A | 12/1997 | Okanishi |
| 5,766,277 | A | 6/1998 | DeVoe |
| 5,833,724 | A | 11/1998 | Wei |
| 5,914,299 | A * | 6/1999 | Harmer ..... B24D 11/001 51/306 |
| 5,946,991 | A | 9/1999 | Hoopman |
| 5,954,844 | A | 9/1999 | Law |
| 5,961,674 | A | 10/1999 | Gagliardi |
| 5,975,987 | A | 11/1999 | Hoopman |
| 5,975,988 | A | 11/1999 | Christianson |
| 5,984,988 | A | 11/1999 | Berg |
| 6,077,601 | A | 6/2000 | DeVoe |
| 6,129,540 | A | 10/2000 | Hoopman |
| 6,139,411 | A | 10/2000 | Everts |
| 6,228,133 | B1 | 5/2001 | Thurber |
| 6,257,973 | B1 | 7/2001 | Fernand Guiselin |
| 6,413,286 | B1 | 7/2002 | Swei |
| 6,511,713 | B2 | 1/2003 | Mathisen |
| 6,526,959 | B1 | 3/2003 | Lee |
| 6,537,140 | B1 | 3/2003 | Miller |
| 6,843,815 | B1 | 1/2005 | Thurber |
| 7,134,953 | B2 | 11/2006 | Reinke |
| 7,524,345 | B2 | 4/2009 | Nevoret |
| 8,142,531 | B2 | 3/2012 | Adefris |
| 8,142,532 | B2 | 3/2012 | Erickson |
| 8,142,891 | B2 | 3/2012 | Culler |
| 8,956,203 | B2 | 2/2015 | Zhang |
| 8,961,269 | B2 | 2/2015 | Zhang |
| 9,200,187 | B2 | 12/2015 | Bauer |
| 9,776,302 | B2 | 10/2017 | Keipert |
| D849,066 | S | 5/2019 | Eckel |
| 2002/0081957 | A1 | 6/2002 | Cisneros |
| 2005/0060941 | A1 | 3/2005 | Provow |
| 2006/0286884 | A1 | 12/2006 | Thioliere |
| 2009/0165394 | A1 | 7/2009 | Culler |
| 2009/0169816 | A1 | 7/2009 | Erickson |
| 2012/0227333 | A1 | 9/2012 | Adefris |
| 2013/0040537 | A1 | 2/2013 | Schwabel |
| 2013/0125477 | A1 | 5/2013 | Adefris |
| 2013/0344786 | A1 * | 12/2013 | Keipert ..... B24D 3/28 451/529 |
| 2014/0290147 | A1 * | 10/2014 | Seth ..... B24D 11/04 51/298 |
| 2015/0004889 | A1 | 1/2015 | Seth |
| 2015/0343603 | A1 | 12/2015 | Breder |
| 2016/0068729 | A1 | 3/2016 | Erickson |
| 2016/0311084 | A1 | 10/2016 | Culler |

FOREIGN PATENT DOCUMENTS

| | | |
|---|---|---|
| CN | 103056751 | 4/2013 |
| CN | 203577871 U | 5/2014 |
| CN | 203650283 U | 6/2014 |
| CN | 104209842 | 12/2014 |
| CN | 204639958 U | 9/2015 |
| EP | 1011924 | 6/2000 |
| EP | 1868770 | 12/2007 |
| JP | 03135090 | 6/1991 |
| JP | 04111778 | 4/1992 |
| JP | 04248167 | 9/1992 |
| JP | 2003048166 | 2/2003 |
| KR | 100813769 | 3/2008 |
| WO | WO 2019-102328 | 5/2015 |
| WO | WO 2019-102329 | 5/2015 |
| WO | WO 2019-102330 | 5/2015 |
| WO | WO 2019-102331 | 5/2015 |
| WO | WO 2019-102332 | 5/2015 |
| WO | WO 2015-100018 | 7/2015 |
| WO | WO 2016-028683 | 2/2016 |
| WO | WO 2016-089675 | 6/2016 |

* cited by examiner

COATED ABRASIVE BELT AND METHODS OF MAKING AND USING THE SAME

BACKGROUND

Coated abrasive belts containing from triangular abrasive platelets are useful for shaping, finishing, or grinding a wide variety of materials and surfaces in the manufacturing of goods. Belt sanders are especially useful when removal of a lot of material is desired. Examples of materials include wood, metals (e.g., especially non-ferrous metals such as aluminum that tend to clog grinding wheels), and flash.

Coated abrasive articles having rotationally aligned triangular abrasive platelets are disclosed in U.S. Pat. No. 9,776,302 (Keipert). The coated abrasive articles have a plurality of triangular abrasive platelets each having a surface feature. The plurality of triangular abrasive platelets is attached to a flexible backing by a make coat comprising a resinous adhesive forming an abrasive layer. The surface features have a specified z-direction rotational orientation that occurs more frequently in the abrasive layer than would occur by a random z-direction rotational orientation of the surface feature.

There continues to be a need for improving the cost, performance, and/or life of the coated abrasive belts.

SUMMARY

In one aspect, the present disclosure provides an abrasive belt comprising:

an endless belt backing;

an abrasive layer disposed on the belt backing, wherein at least a portion of the abrasive layer comprises abrasive elements secured to a major surface of the belt backing by at least one binder material, wherein the abrasive elements are disposed at contiguous intersections of horizontal lines and vertical lines of a rectangular grid pattern, wherein at least 70 percent of the intersections have one of the abrasive elements disposed thereat, wherein each of the abrasive elements has at least two triangular abrasive platelets, wherein each of the triangular abrasive platelets has respective top and bottom surfaces connected to each other, and separated by, three sidewalls, wherein, on a respective basis, one sidewall of at least 90 percent of the triangular abrasive platelets is disposed facing and proximate to the belt backing, wherein a first portion of the abrasive elements is arranged in alternating first rows wherein the triangular abrasive platelets in the first row are disposed lengthwise aligned within 10 degrees of the vertical lines, wherein a second portion of the abrasive elements is arranged in alternating second rows wherein the triangular abrasive platelets in the second row are disposed lengthwise aligned within 10 degrees of the horizontal lines, and wherein the first and second rows repeatedly alternate along the vertical lines.

Accordingly, in another aspect, the present disclosure provides a method of abrading a workpiece, the method comprising frictionally contacting a portion of the abrasive layer of a coated abrasive belt according to the present disclosure with the workpiece, and moving at least one of the workpiece and the abrasive article relative to the other to abrade the workpiece.

In a third aspect, the present disclosure provides a method of making a coated abrasive belt, the method comprising:

disposing a curable make layer precursor on a major surface of an endless belt backing;

embedding abrasive elements into the curable make layer precursor, wherein the abrasive elements are disposed adjacent to contiguous intersections of a horizontal and vertical rectangular grid pattern, wherein at least 70 percent of the intersections have one of the abrasive elements disposed thereat, wherein each of the abrasive elements has at least two triangular abrasive platelets, wherein each of the triangular abrasive platelets has respective top and bottom surfaces connected to each other, and separated by, three sidewalls, wherein, on a respective basis, one sidewall of at least 90 percent of the triangular abrasive platelets is disposed facing and proximate to the belt backing, wherein a first portion of the abrasive elements is arranged in alternating first rows wherein the triangular abrasive platelets in the first row are disposed lengthwise aligned within 10 degrees of the vertical lines, wherein a second portion of the abrasive elements is arranged in alternating second rows wherein the triangular abrasive platelets in the second row are disposed lengthwise aligned within 10 degrees of the horizontal lines, and wherein the first and second rows repeatedly alternate along the vertical lines.

at least partially curing the curable make layer precursor to provide a make layer;

disposing a curable size layer precursor over the at least partially cured make layer precursor and triangular abrasive platelets; and at least partially curing the curable size layer precursor to provide a size layer.

As used herein:

The term "proximate" means very near or next to (e.g., contacting or embedded in a binder layer contacting).

The term "workpiece" refers to a thing being abraded.

As used herein, the term "triangular abrasive platelet", means a ceramic abrasive particle with at least a portion of the abrasive particle having a predetermined shape that is replicated from a mold cavity used to form the shaped precursor abrasive particle. The triangular abrasive platelet will generally have a predetermined geometric shape that substantially replicates the mold cavity that was used to form the triangular abrasive platelet. Triangular abrasive platelet as used herein excludes randomly sized abrasive particles obtained by a mechanical crushing operation.

As used herein, "Z-axis rotational orientation" refers to the angular rotation, about a Z-axis perpendicular to the major surface of the belt backing, of the longitudinal dimension the triangular abrasive platelet sidewall that most faces the belt backing.

Features and advantages of the present disclosure will be further understood upon consideration of the detailed description as well as the appended claims.

Figure 1:
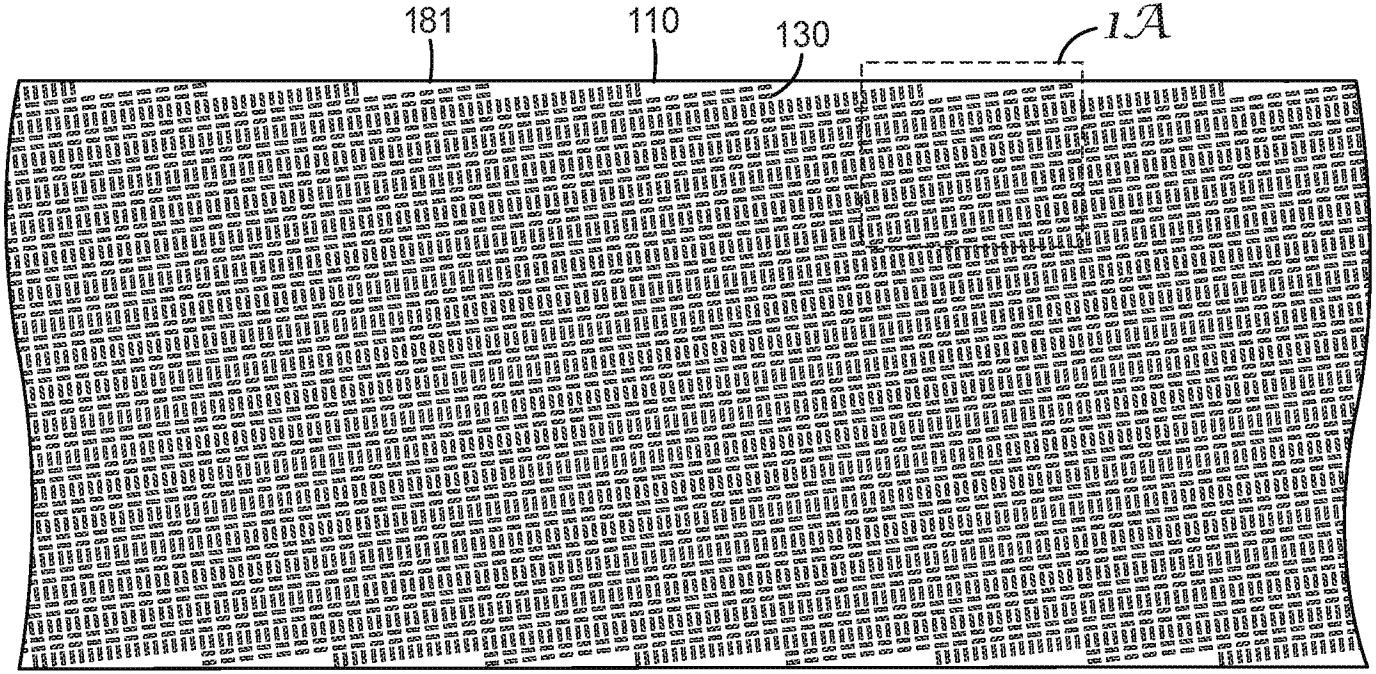
FIG. 1 is a schematic top view of exemplary coated abrasive belt 100.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

FIG. 1 shows an exemplary coated abrasive belt 100 according to the present disclosure, wherein triangular abrasive platelets 130 are secured at precise locations and Z-axis rotational orientations to a belt backing 110 having a longitudinal axis 181.

Figure 1A:
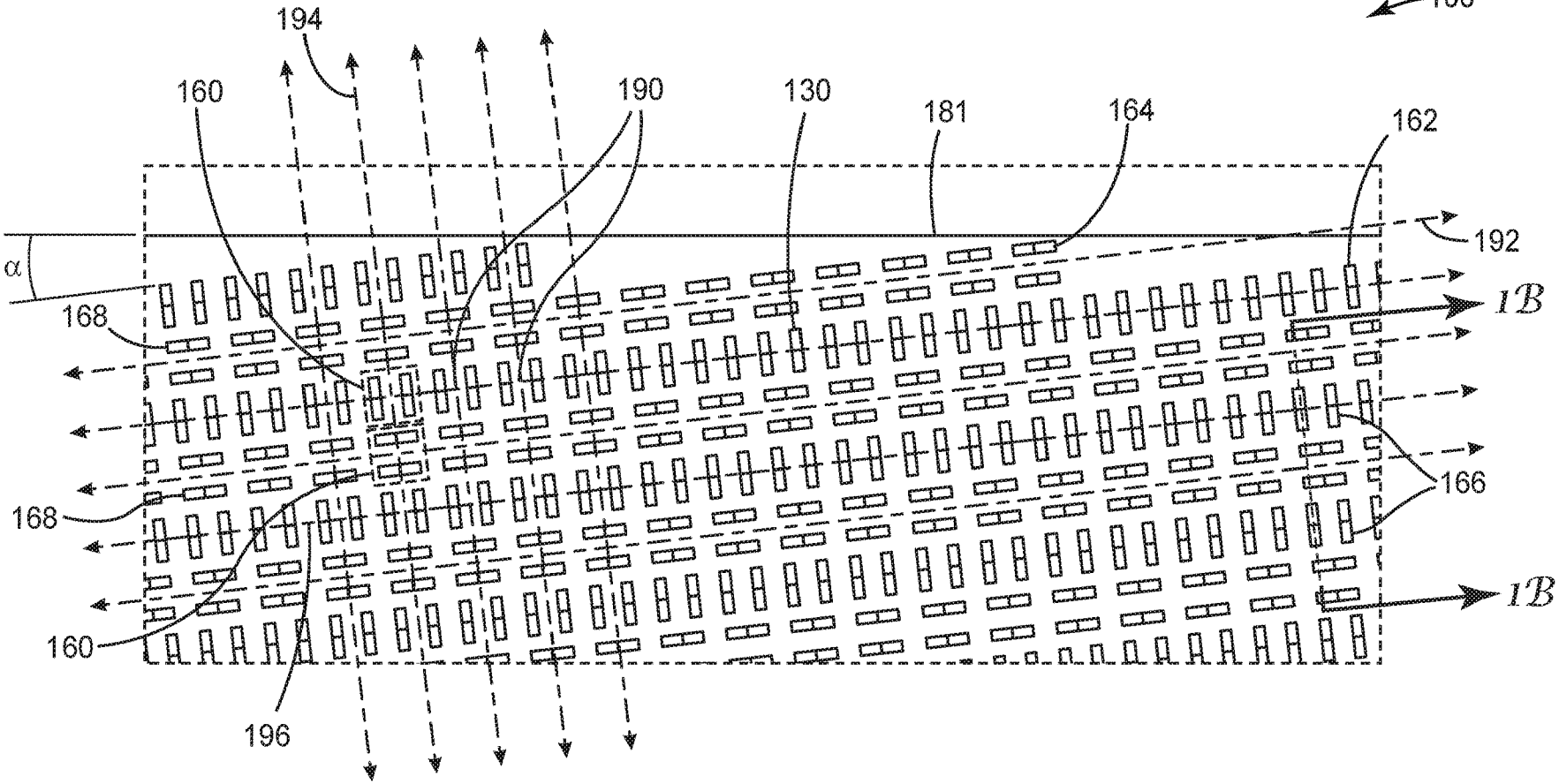
FIG. 1A is an enlarged view of region 1A in FIG. 1.

Referring now to FIG. 1A, abrasive elements 160 each have two triangular abrasive platelets 130. Abrasive elements 160 are disposed at contiguous intersections 190 of horizontal lines 192 and vertical lines 194 of a rectangular grid pattern 196. At least 70 percent of the contiguous intersections have one of the abrasive elements 160 disposed thereat. To avoid scoring during use, the abrasive elements are oriented at an angle $\alpha$ with respect to a longitudinal axis of the coated abrasive belt 100. The angle $\alpha$ may be any angle; for example, between greater than 0 and 30 degrees, or between greater than 0 and 20 degrees, or between 40 and 50 degrees.

A first portion 162 of abrasive elements 160 is arranged in alternating first rows 166. The triangular abrasive platelets 130 in first rows 166 have a respective Z-axis rotational orientation within 10 degrees of the vertical lines 194. A second portion 164 of the abrasive elements is arranged in alternating second rows 168. The triangular abrasive platelets 130 in second rows 168 have a respective Z-axis rotational orientation within 10 degrees of the horizontal lines 192. First and second rows (166, 168) repeatedly alternate along vertical lines 194.

Figure 1B:
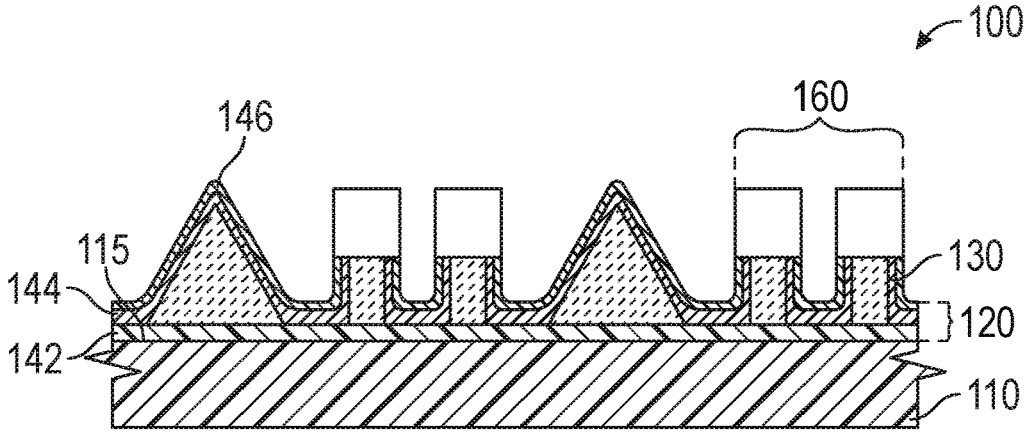
FIG. 1B is a schematic side view of an exemplary coated abrasive belt 100 taken along line 1B-1B.

Referring now to FIGS. 1A and 1B, coated abrasive belt 100 comprises abrasive layer 120 disposed on major surface 115 of belt backing 110. Abrasive layer 120 comprises abrasive elements 160, each having two triangular abrasive platelets 130 secured to major surface 115 by at least one binder material (shown as make layer 142 and size layer 144). Optional supersize layer 146 is disposed on size layer 144.

Figure 2A:
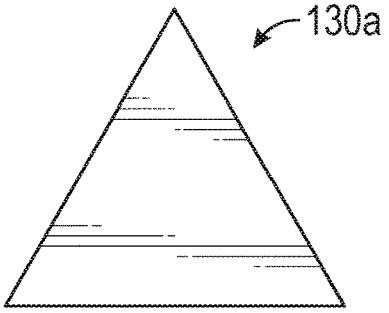
FIG. 2A is a schematic top view of exemplary triangular abrasive platelet 130*a*.
Figure 2B:
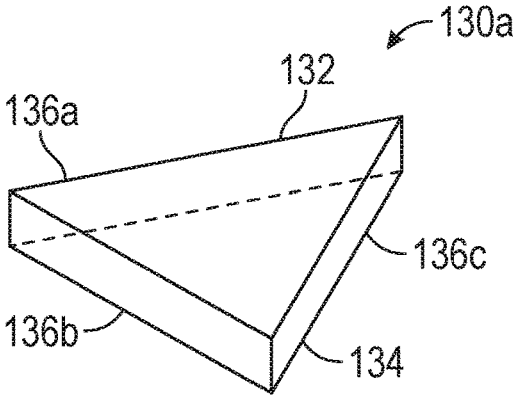
FIG. 2B is a schematic perspective view of exemplary triangular abrasive platelet 130.

Referring now to FIGS. 2A and 2B, each triangular abrasive platelet 130*a* has respective top and bottom surfaces (132, 134) connected to each other, and separated by, three sidewalls (136*a*, 136*b*, 136*c*).

Figure 3A:
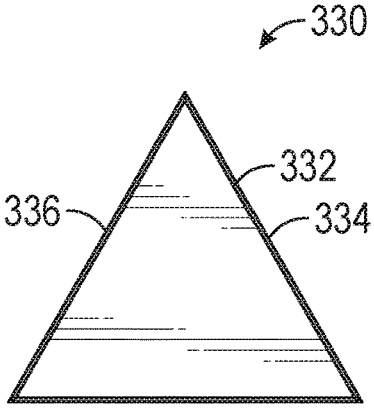
FIG. 3A is a schematic top view of exemplary triangular abrasive platelet 330.
Figure 3B:
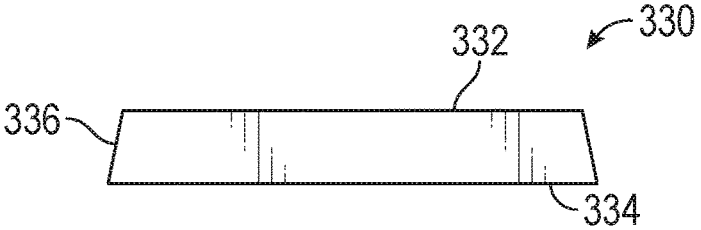
FIG. 3B schematic side view of exemplary triangular abrasive platelet 330.

FIGS. 3A and 3B show another embodiment of a useful triangular abrasive platelet 330, triangular abrasive platelet 330 has respective top and bottom surfaces (332, 334) connected to each other, and separated by, three sloping sidewalls (336).

The belt backing may comprise any known flexible coated abrasive backing, for example. The belt backing should be sufficiently flexible to be wound around rollers in the belt path during use. Suitable materials for the belt backing include polymeric films, metal foils, woven fabrics, knitted fabrics, paper, nonwovens, foams, screens, laminates, combinations thereof, and treated versions thereof. The belt may comprise a splice or be splice-free, e.g., as described in U.S. Pat. No. 7,134,953 (Reinke) and U.S. Pat. No. 5,578,096 (Benedict et al.).

The edges of the belt backing are typically straight and parallel to the longitudinal axis, this is not a requirement as some deviation of the edges (e.g., a scalloped edge) is permissible and may even be desirable in some instances.

The abrasive layer may comprise a single binder layer having abrasive particles retained therein, or more typically, a multilayer construction having make and size layers. Coated abrasive belts according to the present disclosure may include additional layers such as, for example, an optional supersize layer that is superimposed on the abrasive layer, or a backing antistatic treatment layer may also be included, if desired. Exemplary suitable binders can be prepared from thermally curable resins, radiation-curable resins, and combinations thereof.

The make layer can be formed by coating a curable make layer precursor onto a major surface of the backing. The make layer precursor may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant $\alpha,\beta$-unsaturated groups, acrylated urethane, acrylated epoxy, acrylated isocyanurate), epoxy resin (including bis-maleimide and fluorene-modified epoxy resins), isocyanurate resin, and mixtures thereof. Of these, phenolic resins are preferred.

Phenolic resins are generally formed by condensation of phenol and formaldehyde, and are usually categorized as resole or novolac phenolic resins. Novolac phenolic resins are acid-catalyzed and have a molar ratio of formaldehyde to phenol of less than 1:1. Resole (also resol) phenolic resins can be catalyzed by alkaline catalysts, and the molar ratio of formaldehyde to phenol is greater than or equal to one, typically between 1.0 and 3.0, thus presenting pendant methylol groups. Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water.

Resole phenolic resins are typically coated as a solution with water and/or organic solvent (e.g., alcohol). Typically, the solution includes about 70 percent to about 85 percent solids by weight, although other concentrations may be used. If the solids content is very low, then more energy is required to remove the water and/or solvent. If the solids content is very high, then the viscosity of the resulting phenolic resin is too high which typically leads to processing problems.

Phenolic resins are well-known and readily available from commercial sources. Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co. of Bartow, Florida under the trade designation AEROFENE (e.g., AEROFENE 295); and those marketed by Kangnam Chemical Company Ltd. of Seoul, South Korea under the trade designation PHENOLITE (e.g., PHENOLITE TD-2207).

The make layer precursor may be applied by any known coating method for applying a make layer to a backing such as, for example, including roll coating, extrusion die coating, curtain coating, knife coating, gravure coating, and spray coating.

The basis weight of the make layer utilized may depend, for example, on the intended use(s), type(s) of abrasive particles, and nature of the coated abrasive belt being prepared, but typically will be in the range of from 1, 2, 5, 10, or 15 grams per square meter (gsm) to 20, 25, 100, 200, 300, 400, or even 600 gsm. The make layer may be applied by any known coating method for applying a make layer (e.g., a make coat) to a backing, including, for example, roll coating, extrusion die coating, curtain coating, knife coating, gravure coating, and spray coating.

Once the make layer precursor is coated on the backing, the triangular abrasive platelets are applied to and embedded in the make layer precursor. The triangular abrasive platelets are applied nominally according to a predetermined pattern and Z-axis rotational orientation onto the make layer precursor.

In some preferred embodiments, the horizontal and/or vertical spacing between the abrasive elements is from 1 to 3 times, and more preferably 1.2 to 2 times the average length of the sidewalls of the triangular abrasive platelets that are facing the belt backing, although other spacings may also be used.

One sidewall of at least 90 percent (e.g., at least 95 percent, at least 99 percent, or even 100 percent) of each one of the triangular abrasive platelets in the abrasive elements is disposed facing (and preferably proximate to) the belt backing. Further, in the abrasive elements, a sidewall that is disposed facing the belt backing is lengthwise aligned (i.e., has a longitudinal Z-axis rotational orientation) that is within 10 degrees (preferably within 5 degrees, and more preferably within 2 degrees) of the vertical lines or horizontal, depending on their location. In this regard, the Z-axis rotational direction of a sidewall facing the backing is considered to be within 10 degrees of the vertical lines if its Z-axis projection onto the rectangular grid pattern (which is planar) intersects at least one of the vertical lines at an angle of 10 degrees or less (including collinear). Likewise, the Z-axis rotational direction of a sidewall facing the backing is considered to be within 10 degrees of the horizontal lines if its Z-axis projection onto the rectangular grid pattern (which is planar) intersects at least one of the horizontal lines at an angle of 10 degrees or less (including collinear). The triangular abrasive platelets have sufficient hardness to function as abrasive particles in abrading processes. Preferably, the triangular abrasive platelets have a Mohs hardness of at least 4, at least 5, at least 6, at least 7, or even at least 8. Preferably, they comprise alpha alumina.

In some embodiments, the triangular abrasive platelets are shaped as thin triangular prisms, while in other embodiments the triangular abrasive platelets are shaped as truncated triangular pyramids (preferably with a taper angle of about 8 degrees). The triangular abrasive platelets may have different side lengths, but are preferably equilateral on their largest face.

Crushed abrasive or non-abrasive particles may be included in the abrasive layer in addition to the abrasive elements and/or abrasive platelets, preferably in sufficient quantity to form a closed coat (i.e., substantially the maximum possible number of abrasive particles of nominal specified grade(s) that can be retained in the abrasive layer).

Examples of suitable abrasive particles include: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, MN; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles; and combinations thereof. Of these, molded sol-gel derived alpha alumina triangular abrasive platelets are preferred in many embodiments. Abrasive material that cannot be processed by a sol-gel route may be molded with a temporary or permanent binder to form shaped precursor particles which are then sintered to form triangular abrasive platelets, for example, as described in U.S. Pat. Appin. Publ. No. 2016/0068729 A1 (Erickson et al.).

Examples of sol-gel-derived abrasive particles and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the triangular abrasive platelets may be surface-treated with a coupling agent (e.g., an organosilane coupling agent) or other physical treatment (e.g., iron oxide or titanium oxide) to enhance adhesion of the abrasive particles to the binder (e.g., make and/or size layer). The abrasive particles may be treated before combining them with the corresponding binder precursor, or they may be surface treated in situ by including a coupling agent to the binder.

Preferably, the triangular abrasive platelets comprise ceramic abrasive particles such as, for example, sol-gel-derived polycrystalline alpha alumina particles. Triangular abrasive platelets composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Pat. Appln. Publ. Nos. 2009/0165394 A1 (Culler et al.) and 2009/0169816 A1 (Erickson et al.).

Alpha alumina-based triangular abrasive platelets can be made according to well-known multistep processes. Briefly, the method comprises the steps of making either a seeded or non-seeded sol-gel alpha alumina precursor dispersion that can be converted into alpha alumina; filling one or more mold cavities having the desired outer shape of the triangular abrasive platelet with the sol-gel, drying the sol-gel to form precursor triangular abrasive platelets; removing the precursor triangular abrasive platelets from the mold cavities; calcining the precursor triangular abrasive platelets to form calcined, precursor triangular abrasive platelets, and then sintering the calcined, precursor triangular abrasive platelets to form triangular abrasive platelets. The process will now be described in greater detail.

Further details concerning methods of making sol-gel-derived abrasive particles can be found in, for example, U.S. Pat. No. 4,314,827 (Leitheiser); U.S. Pat. No. 5,152,917

(Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

The triangular abrasive platelets may include a single kind of triangular abrasive platelets or a blend of two or more sizes and/or compositions of triangular abrasive platelets. In some preferred embodiments, the triangular abrasive platelets are precisely-shaped in that individual triangular abrasive platelets will have a shape that is essentially the shape of the portion of the cavity of a mold or production tool in which the particle precursor was dried, prior to optional calcining and sintering.

Triangular abrasive platelets used in the present disclosure can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a truncated pyramid. The resultant triangular abrasive platelets have a respective nominal average shape that corresponds to the shape of cavities (e.g., truncated pyramid) in the tool surface; however, variations (e.g., random variations) from the nominal average shape may occur during manufacture, and triangular abrasive platelets exhibiting such variations are included within the definition of triangular abrasive platelets as used herein.

In some embodiments, the base and the top of the triangular abrasive platelets are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to triangular abrasive platelets, the term "length" refers to the maximum dimension of a triangular abrasive platelet. "Width" refers to the maximum dimension of the triangular abrasive platelet that is perpendicular to the length. The terms "thickness" or "height" refer to the dimension of the triangular abrasive platelet that is perpendicular to the length and width.

Examples of sol-gel-derived triangular alpha alumina (i.e., ceramic) abrasive particles can be found in U.S. Pat. No. 5,201,916 (Berg); U.S. Pat. No. 5,366,523 (Rowenhorst (Re 35,570)); and U.S. Pat. No. 5,984,988 (Berg). Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

The triangular abrasive platelets are typically selected to have a length in a range of from 1 micron to 15000 microns, more typically 10 microns to about 10000 microns, and still more typically from 150 to 2600 microns, although other lengths may also be used.

Triangular abrasive platelets are typically selected to have a width in a range of from 0.1 micron to 3500 microns, more typically 100 microns to 3000 microns, and more typically 100 microns to 2600 microns, although other lengths may also be used.

Triangular abrasive platelets are typically selected to have a thickness in a range of from 0.1 micron to 1600 microns, more typically from 1 micron to 1200 microns, although other thicknesses may be used.

In some embodiments, triangular abrasive platelets may have an aspect ratio (length to thickness) of at least 2, 3, 4, 5, 6, or more.

Surface coatings on the triangular abrasive platelets may be used to improve the adhesion between the triangular abrasive platelets and a binder in abrasive articles, or can be used to aid in electrostatic deposition of the triangular abrasive platelets. In one embodiment, surface coatings as described in U.S. Pat. No. 5,352,254 (Celikkaya) in an amount of 0.1 to 2 percent surface coating to triangular abrasive platelet weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the triangular abrasive platelet from capping. Capping is the term to describe the phenomenon where metal particles from the workpiece being abraded become welded to the tops of the triangular abrasive platelets. Surface coatings to perform the above functions are known to those of skill in the art.

The abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10000. According to one embodiment of the present disclosure, the average diameter of the abrasive particles may be within a range of from 260 to 1400 microns in accordance with FEPA grades F60 to F24.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the abrasive particles pass through a test sieve meeting ASTM E-11 specifications for the number 18 sieve and are retained on a test sieve meeting ASTM E-11 specifications for the number 20 sieve. In one embodiment, the abrasive particles have a particle size such that most of the particles pass through an 18 mesh test sieve and can be retained on a 20, 25, 30, 35, 40, 45, or 50 mesh test sieve. In various embodiments, the abrasive particles can have a nominal screened grade of: −18+20, −20+25, −25+30, −30+35, −35+40, −40+45, −45+50, −50+60, −60+70, −70+80, −80+100, −100+120, −120+140, −140+170, −170+200, −200+230, −230+270, −270+325, −325+400, −400+450, −450+500, or −500+635. Alternatively, a custom mesh size can be used such as −90+100.

Referring again to FIG. 1A, rectangular grid pattern 196 is formed by vertical lines 194 (extending in a vertical direction) and horizontal lines 192 (extending in a horizontal direction), which are by definition perpendicular to the vertical lines. The spacing of the vertical lines and/or horizontal lines may be regular or irregular. Preferably, it is regular in both of the vertical and horizontal directions. Preferably the horizontal spacing and vertical spacing will be the same although the horizontal spacing and the vertical spacing may be different. For example, in some preferred embodiments, the regular vertical spacing (i.e., vertical pitch) and horizontal spacing (i.e. horizontal pitch) between triangular abrasive platelets may be from between 1 and 3 times the platelet length. Of course, these spacings may vary depending on the size and thickness of the triangular abrasive platelets.

In some preferred embodiments, the horizontal pitch is from 3 to 6 times, more preferably 3 to 5 times, and even more preferably 4 to 5 times the thickness of the triangular abrasive particles. Likewise, in some preferred embodiments, the vertical pitch is from 1 to 3 times, more preferably from 1.2 to 2 times, and even more preferably 1.2 to 1.5 times the length of the triangular abrasive particles.

Coated abrasive belts according to the present disclosure can be made by a method in which the triangular abrasive platelets are precisely placed and oriented. The method generally involves the steps of filling the cavities in a production tool each with one or more triangular abrasive platelets (typically one or two), aligning the filled production tool and a make layer precursor-coated backing for transfer of the triangular abrasive platelets to the make layer precursor, transferring the abrasive particles from the cavities onto the make layer precursor-coated backing, and removing the production tool from the aligned position. Thereafter, the make layer precursor is at least partially cured (typically to a sufficient degree that the triangular abrasive platelets are securely adhered to the backing), a size layer precursor is then applied over the make layer precursor and abrasive particles, and at least partially cured to provide the coated abrasive belt. The process, which may be batch or continuous, can be practiced by hand or automated, e.g., using robotic equipment. It is not required to perform all steps or perform them in consecutive order, but they can be performed in the order listed or additional steps performed in between.

The triangular abrasive platelets can be placed in the desired Z-axis rotational orientation formed by first placing them in appropriately shaped cavities in a dispensing surface of a production tool arranged to have a complementary rectangular grid pattern.

An exemplary production tool 400 for making the coated abrasive belt 100 shown in FIGS. 1A-1C, formed by casting a thermoplastic sheet, is shown in FIGS. 4 and 4A-4C. Referring now to FIGS. 4 and 4A-4C, production tool 400 has a dispensing surface 410 comprising a rectangular grid pattern 430 of cavities 420 sized and shaped to receive the triangular abrasive platelets. Cavities 420 are Z-axis rotationally aligned so that when filled with triangular abrasive platelets that when they are subsequently transferred they form the desired corresponding pattern and Z-axis rotational orientation in the resultant coated abrasive belt shown in FIG. 1.

Once most, or all, of the cavities are filled with the desired number of triangular abrasive platelets the dispensing surface is brought into close proximity or contact with the make layer precursor layer on the belt backing thereby embedding and transferring the triangular abrasive platelets from the production tool to the make layer precursor while nominally maintaining horizontal orientation. Of course, some unintended loss of orientation may occur, but it should generally be manageable within the ±10 degree or less tolerance.

In some embodiments, the depth of the cavities in the production tool is selected such that the triangular abrasive platelets fit entirely within the cavities. In some preferred embodiments, the triangular abrasive platelets extend slightly beyond the openings of the cavities. In this way, they can be transferred to the make layer precursor by direct contact with reduced chance of resin transfer to the to the production tool. In some preferred embodiments, the center of mass for each triangular abrasive platelet resides within a respective cavity of the production tool when the triangular abrasive platelet is fully inserted into the cavity. If the depth of the cavities becomes too short, with the triangular abrasive platelet's center of mass being located outside of the cavity, the triangular abrasive platelets are not readily retained within the cavities and may jump back out as the production tool is used in the apparatus.

In order to fill the cavities in the production tool, an excess of the triangular abrasive platelets is preferably applied to the dispensing surface of the production tool such that more triangular abrasive platelets are provided than the number of cavities. An excess of triangular abrasive platelets, which means that there are more triangular abrasive platelets present per unit length of the production tool than cavities present, helps to ensure that most or all of the cavities within the production tool are eventually filled with a triangular abrasive platelet as the triangular abrasive platelets accumulate onto the dispensing surface and are moved about either due to gravity or other mechanically applied forces to translate them into a cavity. Since the bearing area and spacing of the abrasive particles is often designed into the production tooling for the specific grinding application, it is generally desirable to not have too much variability in the number of unfilled cavities.

Preferably, a majority of the cavities in the dispensing surface are filled with a triangular abrasive platelet disposed in an individual cavity such that the sides of the cavity and platelet are at least approximately parallel. This can be accomplished by shaping the cavities slightly larger than the triangular abrasive platelets (or multiple thereof). To facilitate filling and release it may be desirable that the cavities have inwardly sloping sidewalls with increasing depth and/or have vacuum openings at the bottoms of the cavities, wherein the vacuum opening lead to a vacuum source. It is desirable to transfer the triangular abrasive platelets onto the make layer precursor-coated backing such that they stand up or are erectly applied. Therefore, the cavity shape is designed to hold the triangular abrasive platelet erectly.

In various embodiments, at least 60, 70, 80, 90, or 95 percent of the cavities in the dispensing surface contain a triangular abrasive platelet. In some embodiments, gravity can be used to fill the cavities. In other embodiments, the production tool can be inverted and vacuum applied to hold the triangular abrasive platelets in the cavities. The triangular abrasive platelets can be applied by spray, fluidized bed (air or vibration), or electrostatic coating, for example. Removal of excess triangular abrasive platelets would be done by gravity as any abrasive particles not retained would fall back down. The triangular abrasive platelets can thereafter be transferred to the make layer precursor-coated belt backing by removing vacuum.

As mentioned above, excess triangular abrasive platelets may be supplied than cavities such that some will remain on the dispensing surface after each cavity has been filled. These excess triangular abrasive platelets can often be blown, wiped, or otherwise removed from the dispensing surface. For example, a vacuum or other force could be applied to hold the triangular abrasive platelets in the cavities and the dispensing surface inverted to clear it of the remaining fraction of the excess triangular abrasive platelets.

After substantially all the cavities in the dispensing surface of the production tool are filled with the triangular abrasive platelets, the dispensing surface of the production tool is brought into proximity with the make layer precursor.

In preferred embodiments, the production tool is formed of a thermoplastic polymer such as, for example, polyethylene, polypropylene, polyester, or polycarbonate from a metal master tool. Fabrication methods of production tools, and of master tooling used in their manufacture, can be found in, for example, U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and U.S. Pat. Appl. Publ. Nos. 2013/0344786 A1 (Keipert) and 2016/0311084 A1 (Culler et al.).

In some preferred embodiments, the production tool is manufactured using 3-D printing techniques.

Once the triangular abrasive platelets have been embedded in the make layer precursor, it is at least partially cured in order to preserve orientation of the mineral during application of the size layer precursor. Typically, this involves B-staging the make layer precursor, but more advanced cures may also be used if desired. B-staging may be accomplished, for example, using heat and/or light and/or use of a curative, depending on the nature of the make layer precursor selected.

Next, the size layer precursor is applied over the at least partially cured make layer precursor and triangular abrasive platelets. The size layer can be formed by coating a curable size layer precursor onto a major surface of the backing. The size layer precursor may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant α,β-unsaturated groups, acrylated urethane, acrylated epoxy, acrylated isocyanurate), epoxy resin (including bis-maleimide and fluorene-modified epoxy resins), isocyanurate resin, and mixtures thereof. If phenolic resin is used to form the make layer, it is likewise preferably used to form the size layer. The size layer precursor may be applied by any known coating method for applying a size layer to a backing, including roll coating, extrusion die coating, curtain coating, knife coating, gravure coating, spray coating, and the like. If desired, a presize layer precursor or make layer precursor according to the present disclosure may be also used as the size layer precursor.

The basis weight of the size layer will also necessarily vary depending on the intended use(s), type(s) of abrasive particles, and nature of the coated abrasive belt being prepared, but generally will be in the range of from 1 or 5 gsm to 300, 400, or even 500 gsm, or more. The size layer precursor may be applied by any known coating method for applying a size layer precursor (e.g., a size coat) to a backing including, for example, roll coating, extrusion die coating, curtain coating, and spray coating.

Once applied, the size layer precursor, and typically the partially cured make layer precursor, are sufficiently cured to provide a usable coated abrasive belt. In general, this curing step involves thermal energy, although other forms of energy such as, for example, radiation curing may also be used. Useful forms of thermal energy include, for example, heat and infrared radiation. Exemplary sources of thermal energy include ovens (e.g., festoon ovens), heated rolls, hot air blowers, infrared lamps, and combinations thereof.

In addition to other components, binder precursors, if present, in the make layer precursor and/or presize layer precursor of coated abrasive belts according to the present disclosure may optionally contain catalysts (e.g., thermally activated catalysts or photocatalysts), free-radical initiators (e.g., thermal initiators or photoinitiators), curing agents to facilitate cure. Such catalysts (e.g., thermally activated catalysts or photocatalysts), free-radical initiators (e.g., thermal initiators or photoinitiators), and/or curing agents may be of any type known for use in coated abrasive belts including, for example, those described herein.

In addition to other components, the make and size layer precursors may further contain optional additives, for example, to modify performance and/or appearance. Exemplary additives include grinding aids, fillers, plasticizers, wetting agents, surfactants, pigments, coupling agents, fibers, lubricants, thixotropic materials, antistatic agents, suspending agents, and/or dyes.

Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium. Examples of other grinding aids include sulfur, organic sulfur compounds, graphite, and metallic sulfides. A combination of different grinding aids can be used.

Exemplary antistatic agents include electrically conductive material such as vanadium pentoxide (e.g., dispersed in a sulfonated polyester), humectants, carbon black and/or graphite in a binder.

Examples of useful fillers for this disclosure include silica such as quartz, glass beads, glass bubbles and glass fibers; silicates such as talc, clays, (montmorillonite) feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate; carbon black; aluminum oxide; titanium dioxide; cryolite; chiolite; and metal sulfites such as calcium sulfite.

Optionally a supersize layer may be applied to at least a portion of the size layer. If present, the supersize typically includes grinding aids and/or anti-loading materials. The optional supersize layer may serve to prevent or reduce the accumulation of swarf (the material abraded from a workpiece) between abrasive particles, which can dramatically reduce the cutting ability of the coated abrasive belt. Useful supersize layers typically include a grinding aid (e.g., potassium tetrafluoroborate), metal salts of fatty acids (e.g., zinc stearate or calcium stearate), salts of phosphate esters (e.g., potassium behenyl phosphate), phosphate esters, urea-formaldehyde resins, mineral oils, crosslinked silanes, crosslinked silicones, and/or fluorochemicals. Useful supersize materials are further described, for example, in U.S. Pat. No. 5,556,437 (Lee et al.). Typically, the amount of grinding aid incorporated into coated abrasive products is about 50 to about 400 gsm, more typically about 80 to about 300 gsm. The supersize may contain a binder such as for example, those used to prepare the size or make layer, but it need not have any binder.

Further details concerning coated abrasive belts comprising an abrasive layer secured to a backing, wherein the abrasive layer comprises abrasive particles and make, size, and optional supersize layers are well known, and may be found, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

Coated abrasive belts according to the present disclosure are useful for abrading a workpiece. Preferred workpieces include metal (e.g., aluminum, mild steel) and wood.

SELECT EMBODIMENTS OF THE PRESENT DISCLOSURE

In a first embodiment, the present disclosure provides an abrasive belt comprising:

an endless belt backing;

an abrasive layer disposed on the belt backing, wherein at least a portion of the abrasive layer comprises abrasive elements secured to a major surface of the belt backing by at least one binder material, wherein the abrasive elements are disposed at contiguous intersections of horizontal lines and vertical lines of a rectangular grid pattern, wherein at least 70 percent of the intersections have one of the abrasive elements disposed thereat, wherein each of the abrasive elements has at least two (e.g., at least 3, at least 4, or at least 5) triangular abrasive platelets, wherein each of the triangular abrasive platelets has respective top and bottom surfaces connected to each other, and separated by, three sidewalls, wherein, on a respective basis, one sidewall of at least 90 percent of the triangular abrasive platelets is disposed facing and proximate to the belt backing, wherein a first portion of the abrasive elements is arranged in alternating first rows wherein the triangular abrasive platelets in the first row are disposed lengthwise aligned within 10 degrees of the vertical lines, wherein a second portion of the abrasive elements is arranged in alternating second rows wherein the triangular abrasive platelets in the second row are disposed lengthwise aligned within 10 degrees of the horizontal lines, and wherein the first and second rows repeatedly alternate along the vertical lines.

In a second embodiment, the present disclosure provides a coated abrasive belt according to the first embodiment, wherein the coated abrasive belt has a longitudinal axis, and wherein the x-axis lines are disposed at an angle relative to the longitudinal axis of the belt, and wherein the angle is between 40 and 50 degrees.

In a third embodiment, the present disclosure provides a coated abrasive belt according to the first or second embodiment, wherein at least 90 percent of the intersections have one of the abrasive elements disposed thereat.

In a fourth embodiment, the present disclosure provides a coated abrasive belt according to any one of the first to third embodiments, wherein the triangular abrasive platelets in the first row are disposed lengthwise aligned within 5 degrees of the vertical lines, wherein the triangular abrasive platelets in the second row are disposed lengthwise aligned within 5 degrees of the horizontal lines.

In a fifth embodiment, the present disclosure provides a coated abrasive belt according to any one of the first to fourth embodiments, wherein the abrasive layer further comprises crushed abrasive or non-abrasive particles.

In a sixth embodiment, the present disclosure provides a coated abrasive belt according to any one of the first to fifth embodiments, wherein the abrasive layer comprises a make layer and a size layer disposed over the make layer and the abrasive elements.

In a seventh embodiment, the present disclosure provides a coated abrasive belt according to any one of the first to sixth embodiments, wherein the triangular abrasive platelets comprise alpha alumina.

In an eighth embodiment, the present disclosure provides a coated abrasive belt according to any one of the first to seventh embodiments, wherein each of the abrasive elements has exactly two triangular abrasive platelets.

In a ninth embodiment, the present disclosure provides a method of abrading a workpiece, the method comprising frictionally contacting a portion of the abrasive layer of a coated abrasive belt according to any one of the first to eighth embodiments with the workpiece, and moving at least one of the workpiece and the abrasive article relative to the other to abrade the workpiece.

In a tenth embodiment, the present disclosure provides a method of making a coated abrasive belt, the method comprising:

disposing a curable make layer precursor on a major surface of a belt backing;

embedding abrasive elements into the curable make layer precursor, wherein at least a portion of the abrasive elements are disposed adjacent to contiguous intersections of a horizontal and vertical rectangular grid pattern, wherein at least 70 percent of the intersections have one of the abrasive elements disposed thereat, wherein each of the abrasive elements has at least two triangular abrasive platelets, wherein each of the triangular abrasive platelets has respective top and bottom surfaces connected to each other, and separated by, three sidewalls, wherein, on a respective basis, one sidewall of at least 90 percent of the triangular abrasive platelets is disposed facing and proximate to the belt backing, wherein a first portion of the abrasive elements is arranged in alternating first rows wherein the triangular abrasive platelets in the first row are disposed lengthwise aligned within 10 degrees of the vertical lines, wherein a second portion of the abrasive elements is arranged in alternating second rows wherein the triangular abrasive platelets in the second row are disposed lengthwise aligned within 10 degrees of the horizontal lines, and wherein the first and second rows repeatedly alternate along the vertical lines.

at least partially curing the curable make layer precursor to provide a make layer;

disposing a curable size layer precursor over the at least partially cured make layer precursor and triangular abrasive platelets; and at least partially curing the curable size layer precursor to provide a size layer.

In an eleventh embodiment, the present disclosure provides a method according to the tenth embodiment, wherein at least 90 percent of the intersections have one of the abrasive elements disposed thereat.

In a twelfth embodiment, the present disclosure provides a method according to the tenth or eleventh embodiment, wherein the coated abrasive belt has a longitudinal axis, and wherein the x-axis lines are disposed at an angle relative to the longitudinal axis of the belt, and wherein the angle is between 40 and 50 degrees.

In a thirteenth embodiment, the present disclosure provides a method according to any one of the tenth to twelfth embodiments, wherein the first portion of the abrasive elements is arranged in first rows wherein the triangular abrasive platelets are disposed lengthwise aligned within 5 degrees of the horizontal lines, and wherein a second portion of the abrasive elements is arranged in second rows wherein the triangular abrasive platelets are disposed lengthwise aligned within 5 degrees of the vertical lines.

In a fourteenth embodiment, the present disclosure provides a method according to any one of the tenth to thirteenth embodiments, wherein the abrasive layer further comprises crushed abrasive or non-abrasive particles.

In a fifteenth embodiment, the present disclosure provides a method according to any one of the tenth to fourteenth embodiments, wherein the triangular abrasive platelets comprise alpha alumina.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Materials used in the Examples are reported in Table 1, below.

TABLE 1

Figure 4:
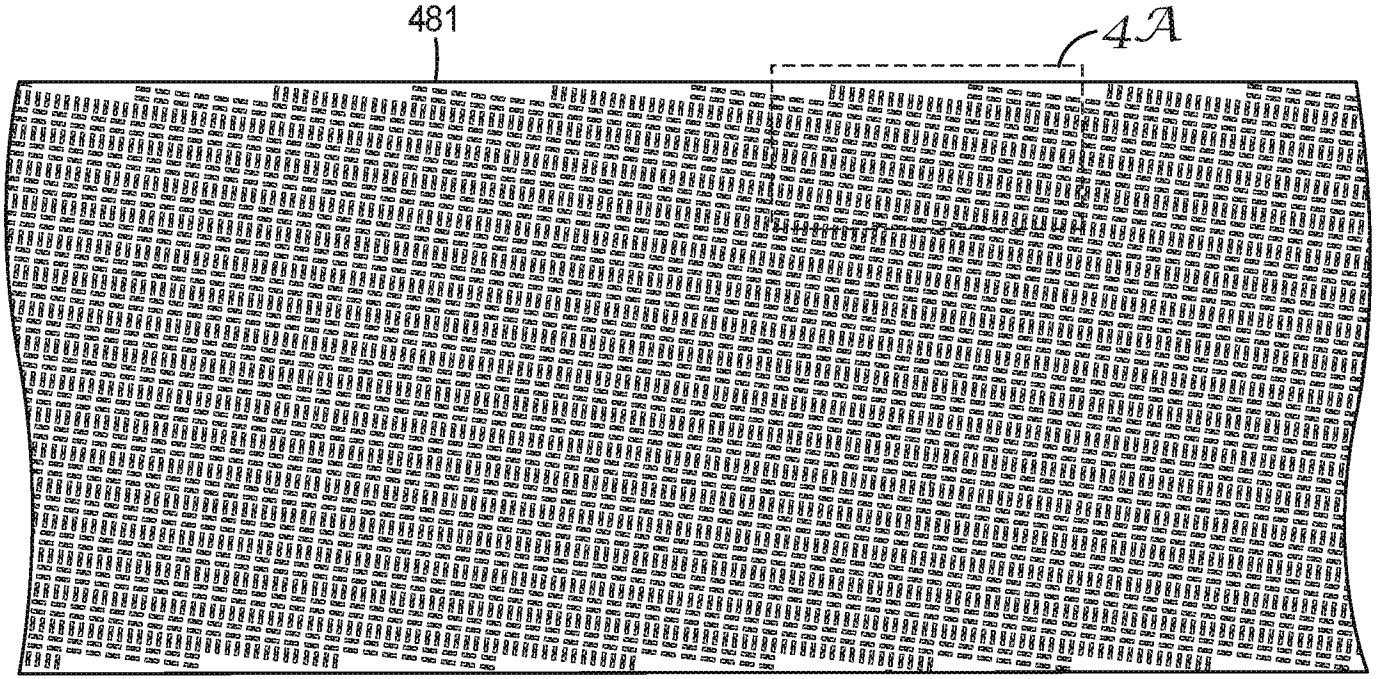
FIG. 4 is a top view of production tool 400 useful for making coated abrasive belt 100.
Figure 4A:
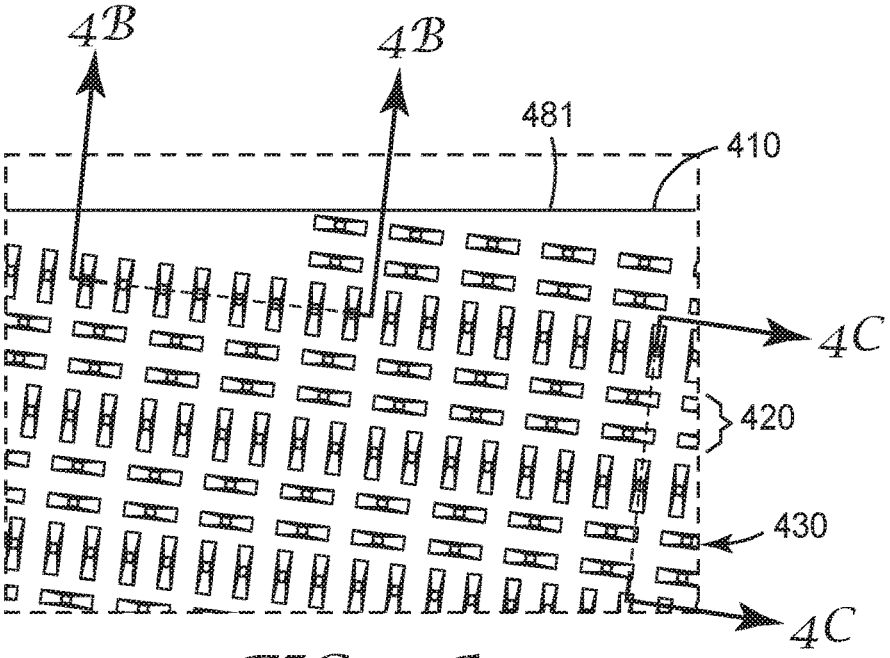
FIG. 4A is a cutaway schematic plan view of a production tool 400.
Figure 4B:
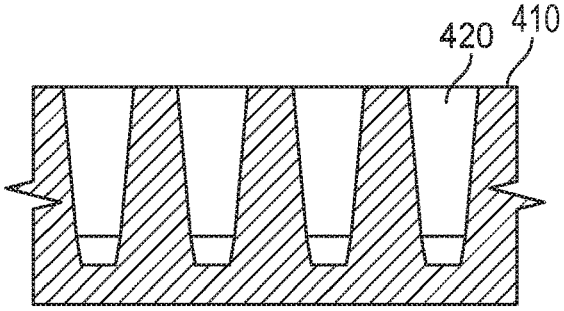
FIG. 4B is a schematic cross-sectional view of production tool 400 taken along line 4B-4B.
Figure 4C:
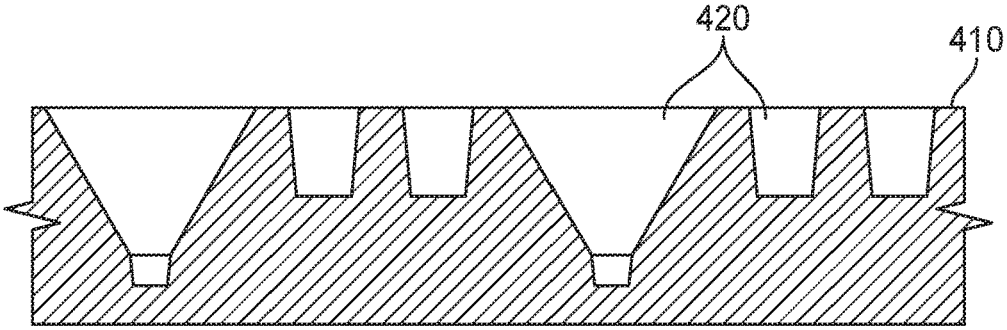
FIG. 4C is a schematic cross-sectional view of production tool 400 taken along line 4C-4C.

| ABBREVIATION | DESCRIPTION |
|---|---|
| BACK | Polyester backing according to the description disclosed in Example 12 of U.S. Pat. No. 6,843,815 (Thurber et al.) |
| FILI | Calcium silicate obtained as M400 WOLLASTOCOAT from NYCO, Willsboro, New York |
| PF1 | Resole phenol-formaldehyde resin having a formaldehyde to phenol weight ratio of 1.5-2.1/1, and catalyzed with 2.5 percent potassium hydroxide |
| MIN | Shaped abrasive particles prepared according to the disclosure of U.S. Pat. No. 8,142,531 (Adefris et al.). The shaped abrasive particles were prepared by molding alumina sol-gel in equilateral triangle-shaped polypropylene mold cavities of side length 0.110 inch (2.8 mm) and a mold depth of 0.028 inch (0.71 mm). The fired shaped abrasive pass through an ASTM 16 (Tyler equivalent 14)-mesh sieve |
| FIL2 | Cryolite obtained under the trade designation CRYOLITE RTN-C from FREEBEE A/S, Ullerslev, Denmark |
| RIO | Red iron oxide pigment, obtained under the trade designation KROMA RO-3097 from Elementis, East Saint Louis, Illinois |
| TOOL1 | A transfer tooling consisting of having vertically-oriented triangular cavities with geometries such as those described in PCT Pat. Publ. No. WO 2015/100018 A1 (Adefris et al.), was prepared by 3-D printing using White VisiJet SL Flex resin from 3D Systems, Rock Hill, South Carolina. The cavities on the tool surface were arranged in an array of paired cavities as generally shown in FIGS. 4 and 4A. The array was oriented at an angle α of 11 degrees with respect to the longitudinal axis of the tool. This pattern was repeated over the surface of the tool for a cavity density of 280 cavities per square inch (43 cavities/$cm^2$). Each of the cavities had a length of 1.875 mm, width of 0.785 mm, depth of 1.62 mm and bottom width of 0.328 mm. The transfer tool was treated with a molybdenum sulfide spray lubricant (obtained as MOLYCOAT from Dow Corning Corporation, Midland, Michigan) to assist abrasive grain release. |
| TOOL2 | A transfer tooling generally the same of TOOL1, except the angle α was 22 degrees instead of 11 degrees. |
| TOOL3 | A transfer tooling generally the same of TOOL1, except the angle α was 47 degrees instead of 11 degrees. |

Example 1

A make resin composition was prepared by charging 3-liter plastic container with 470 grams (g) of PF1, 410 g FIL1, and 22 g water followed by mechanical mixing. The prepared make resin was then coated onto BACK at 75-micrometer wet thickness using a 10-centimeter (cm) wide coating knife obtained from Paul N. Gardner Company, Pompano Beach, Florida, followed by smoothing the coating using a trowel by gently scrapping the top layer of coating to a final coating weight of 148 grams per square meter (gsm).

MIN was then loaded into TOOL1 and transferred to the resin-coated backing generally according to PCT Pat. Publ. No. WO 2015/100018 A1 (Culler et al.).

The belt sample was then cured in a forced air oven for 90 minutes at 90° C. and 60 minutes at 103° C. The belt sample was then coated with a size coat composition, followed by a supersize coat composition. The size coat composition was prepared by charging a 3-liter plastic container with 431.5 g of PF1, 227.5 g of FILL 227.5 g of FIL2 and 17 g of RIO, mechanically mixing and then diluting to a total weight of 1 kg with water. The prepared size coat composition was then coated onto the belt sample at a coverage rate of 482 grams per square meter with a 75 cm paint roller and resultant product was cured at 90° C. for 60 minutes and then at 102° C. for 8 hours more. The supersize coat composition was prepared according to the description disclosed in Example 26 of U.S. Pat. No. 5,441,549 (Helmin) starting at column 21, line 10. The prepared supersize coat composition was then coated onto the belt sample using a 75 cm paint roller with a coverage of 424 grams per meter square. The sample was cured at 90° C. for 30 minutes, 8 hours at 102° C. and 60 minutes at 109° C. After cure, the strip of coated abrasive was converted into a belt using conventional adhesive splicing practices.

Example 2

The procedure generally described in Example 1 was repeated, with the exception that TOOL2 was used instead of TOOL1.

Example 3

The procedure generally described in Example 1 was repeated, with the exception that TOOL3 was used instead of TOOL1.

Comparative Example A

Comparative Example A was obtained as CUBITRON II COAT BELT 984F GRADE 36+ from 3M Company, St. Paul, Minnesota.

Comparative Example B

Comparative Example A was obtained as CUBITRON II COAT BELT 784F GRADE 36+ from 3M Company, St. Paul, Minnesota.

Grinding Performance Test

The grinding performance test was conducted on 10.16-cm by 91.44-cm belts converted from coated abrasives samples made from Examples 1-3 and Comparative Examples A-B. The workpiece was a 304 stainless steel bar on which the surface to be abraded measured 1.9 cm by 1.9 cm. A 20.3-cm diameter serrated contact wheel with 70-durometer rubber, 1:1 land-to-groove ratio was used. The belt was run at 2750 rpm. The workpiece was applied to the center part of the belt at a normal force 4.54 kg to 6.8 kg. Five seconds after the abrasive grind cycle was completed the temperature of the end of the workpiece was measured and recorded by an Omega OS552-MA-6 Infrared (IR) Thermometer. The workpiece was held 15.2 cm (6 inches) away from the thermometer sensor. The weight loss of the workpiece was measured after 15 seconds of grinding. The workpiece would then be cooled and tested again. The test was concluded after 30 cycles. Results are reported in Tables 2 and 3, below.

TABLE 2

| | WORKPIECE MATERIAL REMOVED, grams | | | | |
|---|---|---|---|---|---|
| CYCLE | COMPARATIVE EXAMPLE A | COMPARATIVE EXAMPLE B | EXAMPLE 1 | EXAMPLE 2 | EXAMPLE 3 |
| 1 | 27.68 | 44.16 | 29.03 | 34.93 | 39.05 |
| 2 | 25.16 | 38.67 | 35.07 | 43.34 | 47.25 |
| 3 | 23.20 | 36.12 | 44.28 | 39.98 | 43.67 |
| 4 | 22.59 | 33.49 | 42.68 | 38.88 | 41.34 |
| 5 | 22.31 | 32.23 | 39.75 | 36.27 | 39.03 |
| 6 | 21.81 | 30.20 | 37.56 | 33.91 | 35.95 |
| 7 | 21.81 | 29.43 | 36.31 | 33.25 | 34.99 |
| 8 | 21.66 | 27.71 | 34.36 | 32.35 | 33.78 |
| 9 | 20.87 | 26.27 | 32.83 | 31.77 | 32.62 |
| 10 | 20.12 | 24.70 | 31.84 | 30.72 | 31.20 |
| 11 | 19.43 | 23.06 | 30.10 | 29.18 | 29.85 |
| 12 | 19.73 | 21.61 | 28.65 | 28.36 | 29.30 |
| 13 | 19.47 | 20.03 | 27.06 | 26.98 | 28.14 |
| 14 | 19.11 | 18.54 | 25.66 | 25.59 | 26.74 |
| 15 | 18.65 | 17.28 | 24.49 | 24.32 | 25.98 |
| 16 | 18.23 | 16.53 | 23.62 | 23.41 | 25.27 |
| 17 | 17.40 | 15.75 | 22.72 | 22.31 | 24.14 |
| 18 | 17.12 | 15.05 | 21.74 | 21.39 | 22.94 |
| 19 | 16.86 | 14.24 | 20.54 | 20.95 | 21.74 |
| 20 | 16.75 | 13.64 | 19.87 | 20.01 | 20.95 |
| 21 | 16.53 | 12.96 | 19.09 | 19.07 | 20.11 |
| 22 | 16.38 | 12.55 | 18.12 | 17.93 | 19.26 |
| 23 | 16.20 | 12.06 | 16.97 | 17.09 | 18.38 |
| 24 | 16.23 | 11.83 | 16.19 | 16.41 | 17.88 |
| 25 | 15.90 | 11.36 | 15.11 | 16.04 | 17.34 |
| 26 | 15.35 | 11.04 | 14.82 | 16.04 | 16.28 |
| 27 | 15.13 | 10.58 | 14.51 | 15.49 | 15.85 |
| 28 | 15.07 | 10.03 | 14.05 | 14.70 | 14.99 |
| 29 | 15.43 | 9.85 | 13.4 | 14.58 | 14.57 |
| 30 | 15.17 | 9.46 | 12.71 | 14.07 | 14.14 |
| Total Cut | 567.35 | 610.43 | 763.13 | 759.32 | 802.73 |

TABLE 3

| | TEMPERATURE, ° C. | | | | |
|---|---|---|---|---|---|
| CYCLE | COMPARATIVE EXAMPLE A | COMPARATIVE EXAMPLE B | EXAMPLE 1 | EXAMPLE 2 | EXAMPLE 3 |
| 1 | 141.2 | 102.8 | 147.1 | 110.1 | 105.1 |
| 2 | 152.0 | 98.5 | 115.1 | 94.8 | 93.8 |
| 3 | 157.9 | 114.0 | 98.3 | 100.4 | 95.7 |
| 4 | 159.5 | 124.0 | 96.9 | 101.9 | 98.2 |
| 5 | 153.7 | 130.0 | 105.1 | 107.9 | 103.4 |
| 6 | 152.6 | 119.8 | 100.0 | 106.4 | 97.6 |
| 7 | 159.1 | 131.8 | 109.1 | 113.8 | 107.3 |
| 8 | 171.0 | 143.3 | 117.0 | 117.6 | 114.6 |
| 9 | 167.7 | 151.5 | 119.6 | 120.2 | 118.4 |
| 10 | 176.3 | 157.3 | 124.1 | 130.4 | 120.8 |
| 11 | 173.2 | 155.9 | 125.4 | 121.0 | 124.3 |
| 12 | 171.2 | 161.9 | 131.8 | 138.5 | 127.4 |
| 13 | 170.8 | 163.4 | 135.6 | 144.2 | 130.5 |

TABLE 3-continued

| | TEMPERATURE, ° C. | | | | |
|---|---|---|---|---|---|
| CYCLE | COMPARATIVE EXAMPLE A | COMPARATIVE EXAMPLE B | EXAMPLE 1 | EXAMPLE 2 | EXAMPLE 3 |
| 14 | 171.5 | 168.3 | 141.6 | 151.8 | 137.8 |
| 15 | 170.9 | 168.6 | 136.8 | 150.9 | 133.1 |
| 16 | 170.1 | 173.5 | 145.0 | 142.3 | 141.0 |
| 17 | 172.8 | 175.7 | 149.7 | 151.2 | 142.3 |
| 18 | 172.7 | 178.0 | 148.8 | 156.6 | 146.9 |
| 19 | 185.0 | 176.6 | 151.4 | 156.7 | 152.5 |
| 20 | 186.8 | 184.6 | 157.5 | 159.3 | 153.7 |
| 21 | 189.8 | 183.5 | 161.5 | 164.7 | 159.5 |
| 22 | 192.9 | 184.8 | 160.9 | 172.7 | 161.3 |
| 23 | 191.1 | 184.6 | 164.6 | 170.0 | 158.6 |
| 24 | 194.9 | 191.6 | 168.6 | 174.6 | 156 |
| 25 | 192.0 | 188.6 | 172.9 | 178.0 | 157.6 |
| 26 | 174.2 | 194.4 | 173.9 | 175.1 | 176.4 |
| 27 | 189.4 | 195.2 | 173.7 | 175.7 | 175.1 |
| 28 | 191.5 | 193.2 | 175.2 | 177.2 | 177.3 |
| 29 | 183.1 | 192.7 | 178.0 | 179.2 | 184.7 |
| 30 | 183.9 | 193.9 | 174.8 | 180.3 | 182.9 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. An abrasive belt comprising:

an endless belt backing;

an abrasive layer disposed on the belt backing, wherein at least a portion of the abrasive layer comprises abrasive elements secured to a major surface of the belt backing by at least one binder material, wherein the abrasive elements are disposed at contiguous intersections of horizontal lines and vertical lines of a rectangular grid pattern, wherein at least 70 percent of the intersections have one of the abrasive elements disposed thereat, wherein each of the abrasive elements has at least two triangular abrasive platelets, wherein each of the triangular abrasive platelets has respective top and bottom surfaces connected to each other, and separated by, three sidewalls, wherein, on a respective basis, one sidewall of at least 90 percent of the triangular abrasive platelets is disposed facing and proximate to the belt backing, wherein the abrasive elements are arranged in first rows and second rows, wherein all the triangular abrasive platelets in the first rows having one sidewall disposed facing and proximate to the belt backing are disposed lengthwise aligned within 10 degrees of the vertical lines, wherein all the triangular abrasive platelets in the second rows having one sidewall disposed facing and proximate to the belt backing are disposed lengthwise aligned within 10 degrees of the horizontal lines, wherein the first and second rows repeatedly alternate along the vertical lines such that any two adjacent first rows are separated only by one of the second rows and any two adjacent second rows are separated only by one of the first rows, and wherein spacing of the vertical lines and spacing of the horizontal lines are the same.

2. The abrasive belt of claim 1, wherein the abrasive belt has a longitudinal axis, and wherein the horizontal lines are disposed at an angle relative to the longitudinal axis of the abrasive belt, and wherein the angle is between 40 and 50 degrees.

3. The abrasive belt of claim 2, wherein at least 90 percent of the intersections have one of the abrasive elements disposed thereat.

4. The abrasive belt of claim 2, wherein all the triangular abrasive platelets in the first rows are disposed lengthwise aligned within 5 degrees of the vertical lines, wherein all the triangular abrasive platelets in the second rows are disposed lengthwise aligned within 5 degrees of the horizontal lines.

5. The abrasive belt of claim 2, wherein the abrasive layer further comprises crushed abrasive or non-abrasive particles.

6. The abrasive belt of claim 2, wherein the abrasive layer comprises a make layer and a size layer disposed over the make layer and the abrasive elements.

7. The abrasive belt of claim 2, wherein the triangular abrasive platelets comprise alpha alumina.

8. The abrasive belt of claim 1, wherein at least 90 percent of the intersections have one of the abrasive elements disposed thereat.

9. The abrasive belt of claim 1, wherein all the triangular abrasive platelets in the first rows are disposed lengthwise aligned within 5 degrees of the vertical lines, wherein all the triangular abrasive platelets in the second rows are disposed lengthwise aligned within 5 degrees of the horizontal lines.

10. The abrasive belt of claim 1, wherein the abrasive layer further comprises crushed abrasive or non-abrasive particles.

11. The abrasive belt of claim 1, wherein the abrasive layer comprises a make layer and a size layer disposed over the make layer and the abrasive elements.

12. The abrasive belt of claim 1, wherein the triangular abrasive platelets comprise alpha alumina.

13. The abrasive belt of claim 1, wherein each of the abrasive elements has exactly two triangular abrasive platelets.

14. A method of abrading a workpiece, the method comprising frictionally contacting a portion of the abrasive layer of an abrasive belt according to claim 1 with the workpiece, and moving at least one of the workpiece and the abrasive belt relative to the other to abrade the workpiece.

15. A method of making a coated abrasive belt, the method comprising:

disposing a curable make layer precursor on a major surface of a belt backing;

embedding abrasive elements into the curable make layer precursor, wherein at least some of the abrasive elements are disposed adjacent to contiguous intersections of horizontal lines and vertical lines of a rectangular grid pattern, wherein at least 70 percent of the intersections have one of the abrasive elements disposed thereat, wherein each of the abrasive elements has at least two triangular abrasive platelets, wherein each of the triangular abrasive platelets has respective top and bottom surfaces connected to each other, and separated by, three sidewalls, wherein, on a respective basis, one sidewall of at least 90 percent of the triangular abrasive platelets is disposed facing and proximate to the belt backing, wherein the abrasive elements are arranged in first rows and second rows, wherein all the triangular abrasive platelets in the first rows having one sidewall disposed facing and proximate to the belt backing are disposed lengthwise aligned within 10 degrees of the vertical lines, wherein all the triangular abrasive platelets in the second rows having one sidewall disposed facing and proximate to the belt backing are disposed lengthwise aligned within 10 degrees of the horizontal lines, and wherein the first and second rows repeatedly alternate along the vertical lines, such that any two adjacent first rows are separated only by one of the second rows and any two adjacent second rows are separated only by one of the first rows, and wherein spacing of the vertical lines and spacing of the horizontal lines are the same;

at least partially curing the curable make layer precursor to provide an at least partially cured make layer;

disposing a curable size layer precursor over the at least partially cured make layer and the abrasive elements; and at least partially curing the curable size layer precursor to provide a size layer.

16. The method of claim 15, wherein at least 90 percent of the intersections have one of the abrasive elements disposed thereat.

17. The method of claim 15, wherein the coated abrasive belt has a longitudinal axis, and wherein the horizontal lines are disposed at an angle relative to the longitudinal axis of the coated abrasive belt, and wherein the angle is between 40 and 50 degrees.

18. The method of claim 15, wherein all the triangular abrasive platelets in the second rows are disposed lengthwise aligned within 5 degrees of the horizontal lines, and wherein all the triangular abrasive platelets in the first rows are disposed lengthwise aligned within 5 degrees of the vertical lines.

19. The method of claim 15, wherein the abrasive layer further comprises crushed abrasive or non-abrasive particles.

20. The method of claim 15, wherein the triangular abrasive platelets comprise alpha alumina.

* * * * *